US009951298B2

(12) United States Patent
Li et al.

(10) Patent No.: US 9,951,298 B2
(45) Date of Patent: Apr. 24, 2018

(54) FLUORESCENT BRIGHTENER PREMIX

(71) Applicant: The Procter & Gamble Company, Cincinnati, OH (US)

(72) Inventors: Fei Li, Beijing (CN); Fangfang Feng, Beijing (CN); Liyuan Niu, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 2 days.

(21) Appl. No.: 14/595,398

(22) Filed: Jan. 13, 2015

(65) Prior Publication Data

US 2015/0203792 A1 Jul. 23, 2015

(30) Foreign Application Priority Data

Jan. 20, 2014 (WO) ..... PCT/CN2014/070867

(51) Int. Cl.

| | |
|---|---|
| ***C11D 1/72*** | (2006.01) |
| ***C11D 3/42*** | (2006.01) |
| ***C11D 3/43*** | (2006.01) |
| ***C11D 3/34*** | (2006.01) |
| ***C11D 1/83*** | (2006.01) |
| *C11D 1/14* | (2006.01) |
| *C11D 1/22* | (2006.01) |
| *C11D 1/29* | (2006.01) |

(52) U.S. Cl.

CPC ..... *C11D 3/349* (2013.01); *C11D 1/72* (2013.01); *C11D 1/83* (2013.01); *C11D 3/42* (2013.01); *C11D 1/146* (2013.01); *C11D 1/22* (2013.01); *C11D 1/29* (2013.01)

(58) Field of Classification Search

CPC .... C11D 1/72; C11D 3/28; C11D 3/42; C11D 3/2006; C11D 3/201; C11D 3/2041; C11D 3/2044

USPC ..... 510/325, 356, 500, 505, 506

See application file for complete search history.

(56) References Cited

U.S. PATENT DOCUMENTS

| | | | | |
|---|---|---|---|---|
| 3,407,196 | A | 10/1968 | Liechti et al. | |
| 3,953,380 | A | 4/1976 | Sundby | |
| 4,562,002 | A | 12/1985 | Neiditch et al. | |
| 4,605,511 | A | 8/1986 | Fringeli | |
| 4,790,953 | A | 12/1988 | Mansy | |
| 4,946,619 | A | 8/1990 | Fisher | |
| 4,968,451 | A | 11/1990 | Scheibel et al. | |
| 4,978,475 | A | 12/1990 | Halas | |
| 5,174,927 | A | 12/1992 | Honsa | |
| 5,338,491 | A | 8/1994 | Connor et al. | |
| 5,419,853 | A | 5/1995 | Kemen | |
| 5,466,802 | A * | 11/1995 | Panandiker | C11D 3/42 510/261 |
| 5,529,710 | A | 6/1996 | Van Dijk et al. | |
| 5,817,614 | A * | 10/1998 | Miracle | C07D 217/10 252/186.38 |
| 5,830,845 | A | 11/1998 | Trinh et al. | |
| 5,861,370 | A | 1/1999 | Trinh et al. | |
| 5,977,055 | A | 11/1999 | Trinh et al. | |
| 6,949,501 | B2 | 9/2005 | Himmrich et al. | |
| 7,205,269 | B2 | 4/2007 | Sadlowski et al. | |
| 7,208,459 | B2 | 4/2007 | Sadlowski et al. | |
| 7,863,236 | B2 | 1/2011 | Kaschig et al. | |
| 8,283,303 | B2 | 10/2012 | Ogura et al. | |
| 8,461,095 | B2 | 6/2013 | Torres et al. | |
| 2002/0022585 | A1 | 2/2002 | Morelli et al. | |
| 2004/0016059 | A1* | 1/2004 | Dresco | C11D 3/0031 8/115.51 |
| 2004/0038852 | A1* | 2/2004 | Brown | C11D 3/0021 510/499 |
| 2004/0186040 | A1* | 9/2004 | Danner | C11D 1/83 510/503 |
| 2006/0089294 | A1* | 4/2006 | Depoot | C11D 1/04 510/515 |
| 2008/0146482 | A1 | 6/2008 | Schneiderman et al. | |
| 2008/0280805 | A1* | 11/2008 | English, III | C11D 1/123 510/414 |
| 2014/0249067 | A1 | 9/2014 | Cost et al. | |

FOREIGN PATENT DOCUMENTS

| | | |
|---|---|---|
| EP | 0 368 383 A3 | 5/1990 |
| EP | 0 397 245 B1 | 11/1990 |
| EP | 0 596 185 A1 | 5/1994 |
| EP | 0 342 177 B1 | 7/1995 |
| EP | 0 837 124 A2 | 4/1996 |
| GB | 2 217 340 | 10/1989 |
| JP | 9-241695 A | 9/1997 |
| JP | 2001-172681 A | 6/2001 |
| JP | 2004083480 A | 3/2004 |
| JP | 2005-179570 A | 7/2005 |
| WO | WO 92/06159 A1 | 4/1992 |

(Continued)

OTHER PUBLICATIONS

International Search Report for Application PCT/US2014/019190, dated Jun. 4, 2014, containing 13 pages.

PCT International Search Report; International Application No. PCT/CN2014/070867; 5 pages.

*Primary Examiner* — Gregory R Delcotto

(74) *Attorney, Agent, or Firm* — John T. Dipre; Steven W. Miller

(57) ABSTRACT

A fluorescent brightener premix comprising from 1% to 15% of a fluorescent brightener and 10% to 80% of an alkoxylated nonionic surfactant, by weight of the premix. The premix, upon being added into a liquid composition, has minimized impact on the pH of the liquid composition.

6 Claims, No Drawings

(56) References Cited

FOREIGN PATENT DOCUMENTS

| | | | |
|---|---|---|---|
| WO | WO9513358 | A1 | 5/1995 |
| WO | WO 98/03619 | A1 | 1/1998 |
| WO | WO 98/08924 | A2 | 3/1998 |
| WO | WO 99/36501 | A1 | 7/1999 |
| WO | WO 2011/133378 | A1 | 10/2011 |

* cited by examiner

FLUORESCENT BRIGHTENER PREMIX

FIELD OF THE INVENTION

The present invention relates to a fluorescent brightener premix and a process of making the same. The present invention also relates to a process of making a liquid cleaning composition comprising the fluorescent brightener premix.

BACKGROUND OF THE INVENTION

Fluorescent brighteners are a class of fluorescent materials that absorb light in the ultraviolet regions of the electromagnetic spectrum (e.g., less than 400 nm) and re-emit light in the violet and blue regions of the electromagnetic spectrum (e.g., greater than 400 nm). Fluorescent brighteners have been used in a variety of applications, e.g., in a laundry detergent composition, to enhance the color or appearance of materials, such as treated fabrics. Generally, fluorescent brighteners are used to increase the perceived whiteness of such materials by increasing the overall amount of blue light emanating from the material, i.e., reflected from the material and emitted by substances deposited on the material.

Fluorescent brighteners are typically in a particulate form and therefore added into liquid compositions via liquid premixes. Forming a fluorescent brightener premix and adding the premix to the liquid composition, rather than adding particulate fluorescent brighteners directly to the liquid composition, allows for more evenly distribution of the fluorescent brightener in the liquid composition. Also, good physical stability (i.e., a stable viscosity profile and no phase splitting) is desired for fluorescent brightener premixes as this property enables a prolonged storage of the premix prior to being added into liquid compositions.

In traditional fluorescent brightener premixes, monoethanolamine (MEA) is the main solvent used to dissolve particulate fluorescent brighteners, e.g., brightener 15 (disodium 4,4'-bis {[4-anilino-6-morpholino-s-triazin-2-yl]-amino}-2,2'-stilbenedisulfonate). MEA is known to act as a counterion to fluorescent brighteners and thus provides improved physical stability to the premix. However, MEA is a primary amine characterized by partial protonation in an aqueous solution and capable of receiving a hydrogen ion from water, resulting in an increase of the OH-ion concentration in the solution (i.e., higher pH of the solution). Thus, upon being added into a liquid composition, such fluorescent brightener premixes containing MEA impact the pH of the liquid composition significantly. This significant pH change of the liquid composition in the manufacturing process is undesired as it requires further pH adjustment equipments or steps. In an in-line process, the issue becomes even more severe due to the precise control of each added ingredient required by an in-line process.

Thus, there is a need for a fluorescent brightener premix that, upon being added into a liquid composition, has minimized impact on the pH of the liquid composition. In particular, the present invention provides a fluorescent brightener premix that has a relatively neutral pH when diluted, compared with those premixes in the art.

It is an advantage of the present invention to provide a fluorescent brightener premix that is physically stable during storage.

It is another advantage of the present invention to provide a physically stable fluorescent brightener premix that does not require either agitation or heating during storage.

It is yet another advantage of the present invention to provide a physically stable fluorescent brightener premix from a variety of fluorescent brightener raw materials, including those containing impurities.

It is even yet another advantage of the present invention to provide an in-line process of making a liquid cleaning composition comprising a fluorescent brightener mix, without requiring a further pH adjustment equipment or step.

SUMMARY OF THE INVENTION

The present invention relates to a fluorescent brightener premix, comprising:

a) from 1% to 15%, by weight of the premix, of a fluorescent brightener; and b) from 10% to 80%, by weight of the premix, of an alkoxylated nonionic surfactant, wherein the premix has a pH value of 6 to 10 when diluted in water at a concentration of 1%.

In another aspect, the present invention is directed to a process of making the fluorescent brightener premix, comprising the step of combing the fluorescent brightener with the alkoxylated nonionic surfactant.

In yet another aspect, the present invention is directed to a process of making a liquid cleaning composition comprising the fluorescent brightener premix, comprising the step of combining the fluorescent brightener premix with an anionic surfactant to form the liquid cleaning composition, wherein the anionic surfactant is selected from the group consisting of alkyl ethoxy sulfate (AES), alkyl sulfate (AS), linear alkylbenzene sulfonate (LAS), and a combination thereof, and wherein the fluorescent brightener premix is present in the liquid cleaning composition from 0.1% to 5% by weight of the liquid cleaning composition.

DETAILED DESCRIPTION OF THE INVENTION

In the present invention, it has been surprisingly found that the fluorescent brightener premix, when added into a liquid cleaning composition, has minimized impact on the pH of the liquid composition. Specifically, the fluorescent brightener premix of the present invention has a pH value of 6 to 10 when diluted in water at a concentration of 1% (a context analogous to when the fluorescent brightener premix is added to a liquid cleaning composition to achieve a typical level of about 1% by weight). Without wishing to be bound by theory, the pH value of a material in an aqueous solution is determined by acidic or basic electrolytes in the material. In the present invention, the solvents are selected from non-electrolytes and consequently do not cause substantial changes to the hydrogen ion activity in the aqueous solution. Thus, when added into a liquid cleaning composition, the fluorescent brightener premix does not impact the pH value of the composition significantly. By contrast, monoethanolamine (MEA) used in traditional fluorescent brightener premixes is a weak base capable of receiving a hydrogen ion from water, thereby leading to an increase of OH— ion concentration in the solution. In other words, these traditional fluorescent brighteners containing MEA significantly increases the pH value of the liquid composition to which they are added.

Moreover, the fluorescent brightener premix of the present invention demonstrates improved physical stability during storage, without having to require either agitation or heating.

Definitions

As used herein, the term "liquid cleaning composition" means a liquid composition relating to cleaning or treating: fabrics, hard or soft surfaces, skin, hair, or any other surfaces in the area of fabric care, home care, skin care, and hair care. The cleaning compositions include, but are not limited to: laundry detergent, laundry detergent additive, fabric softener, carpet cleaner, floor cleaner, bathroom cleaner, toilet cleaner, sink cleaner, dishwashing detergent, air care, car care, skin moisturizer, skin cleanser, skin treatment emulsion, shaving cream, hair shampoo, hair conditioner, and the like. Preferably, the liquid cleaning composition is a liquid laundry detergent composition, a liquid fabric softener composition, or a liquid dishwashing detergent composition, more preferably is a liquid laundry detergent composition. The liquid cleaning composition may be either aqueous or non-aqueous, but preferably is aqueous, and may be anisotropic, isotropic, or combinations thereof.

As used herein, the term "physically stable" means maintenance of commercially acceptable viscosity and no phase splitting in a premix or composition. In the context of the present invention, a commercially acceptable viscosity value is below 300 cps at a shear rate of 1/sec. Unless specifically indicated to the contrary, all stated viscosities are those measured at a shear rate of 1/sec and at a temperature of 21° C. Viscosity herein can be measured with any suitable viscosity-measuring instrument, e.g., a Brookfield DV-II+ Rheometer at a shear rate of 1/sec and Spindle 31.

As used herein, the term "combine" refers to ingredients added together, with or without substantial mixing towards achieving homogeneity.

As used herein, the terms "substantially free of" means that the indicated ingredient is at the very minimum not deliberately added to a premix or composition to form part of it, or, preferably, is not present at analytically detectable levels. It is meant that the premix or composition comprises less than a trace amount, alternatively less than 0.1%, alternatively less than 0.01%, alternatively less than 0.001%, by weight of the premix or composition, of the indicated ingredient.

As used herein, the articles including "a" and "an" when used in a claim, are understood to mean one or more of what is claimed or described.

As used herein, the terms "comprise" "comprises" "comprising" "include", "includes", and "including" are meant to be non-limiting, i.e., other steps and other ingredients which do not affect the end of result can be added. The above terms encompass the terms "consisting of" and "consisting essentially of".

Fluorescent Brightener Premix

The fluorescent brightener premix of the present invention comprises: from 1% to 15%, by weight of the premix, of a fluorescent brightener, and from 10% to 80%, by weight of the premix, of an alkoxylated nonionic surfactant. Preferably, the premix further comprises one or more adjunct ingredients.

When diluted in water at a concentration of 1%, the fluorescent brightener premix herein has a pH value of 6 to 10, preferably of 6 to 9, more preferably of 6 to 8, even more preferably of 6.5 to 8, yet even more preferably of 6.5 to 7, alternatively of 6.5 to 7.0. As described above, the premix has a relatively neutral pH when diluted and therefore does not cause a significant change to the pH value of the liquid cleaning composition to which it is added (i.e., the present premix has a relatively low buffer capacity). However, this does not necessarily mean that the premix has an initial pH (the pH value of the premix before it is diluted) that is relatively neutral. In one embodiment, the initial pH value of the fluorescent brightener premix is from 7 to 13, preferably from 8 to 12, more preferably from 9 to 11.

Preferably, the fluorescent brightener premix herein is substantially free of MEA because MEA leads to an increase in the pH of the solution when diluted in water. Alternatively, the premix is substantially free of alkanolamine, preferably is substantially free of alkanolamine selected from the group consisting of methanolamine, ethanolamine, propaneolamine. In an alternative embodiment, the premix is substantially free of an electrolyte that ionizes when diluted in water.

The fluorescent brightener premix herein is in a liquid form and has a viscosity value below 250 cps, preferably from 30 cps to 200 cps, more preferably from 50 cps to 150 cps, at a shear rate of 1/sec and at 21° C. Also, the premix has good physical stability during storage. In one embodiment, the premix has a viscosity value below 200 cps, preferably from 50 cps to 150 cps, at a shear rate of 1/sec, while being stored at 21° C. for at least 2 weeks.

Fluorescent Brightener

The fluorescent brightener premix of the present invention comprises a fluorescent brightener at a level of from 1% to 15%, preferably from 3% to 12%, more preferably from 5% to 10%, even more preferably from 6% to 9%, by weight of the premix.

The fluorescent brightener may be in a powder or liquid form, but preferably is in a powder form. More preferably, the fluorescent brightener is in a micronized particulate form, having a weight average primary particle size of from 10 to 600 micrometers, alternatively from 20 to 500 micrometers, alternatively from 30 to 400 micrometers.

Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. Examples of such fluorescent brighteners are disclosed in U.S. Pat. No. 7,863,236 and its CN equivalent No. 1764714.

In one embodiment, the fluorescent brightener herein comprises a compound of formula (1):

(1)

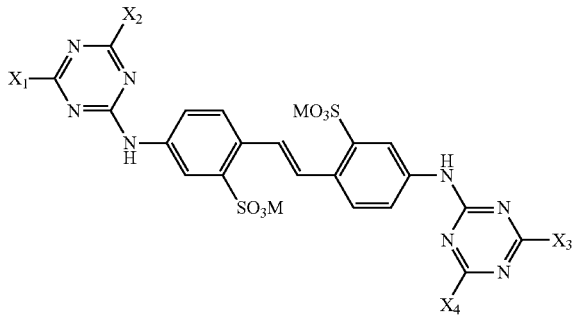

wherein: $X_1$, $X_2$, $X_3$, and $X_4$ are —$N(R^1)R^2$, wherein $R^1$ and $R^2$ are independently selected from a hydrogen, a phenyl, hydroxyethyl, or an unsubstituted or substituted $C_1$-$C_8$ alkyl, or —$N(R^1)R^2$ form a heterocyclic ring, preferably $R^1$ and $R^2$ are independently selected from a hydrogen or phenyl, or —$N(R^1)R^2$ form a unsubstituted or substituted morpholine ring; and M is a hydrogen or a cation, preferably M is sodium or potassium, more preferably M is sodium.

Preferably, the fluorescent brightener is selected from the group consisting of disodium 4,4'-bis {[4-anilino-6-morpholino-s-triazin-2-yl]-amino}-2,2'-stilbenedisulfonate (brightener 15, commercially available under the tradename Tinopal AMS-GX by Ciba Geigy Corporation), disodium 4,4'-bis {[4-anilino-6-(N-2-bis-hydroxyethyl)-s-triazine-2-yl]-amino}-2,2'-stilbenedisulonate (commercially available under the tradename Tinopal UNPA-GX by Ciba-Geigy Corporation), disodium 4,4'-bis {[4-anilino-6-(N-2-hydroxyethyl-N-methylamino)-s-triazine-2-yl]-amino}-2,2'-stilbenedisulfonate (commercially available under the tradename Tinopal 5BM-GX by Ciba-Geigy Corporation). More preferably, the fluorescent brightener is disodium 4,4'-bis{[4-anilino-6-morpholino-s-triazin-2-yl]-amino}-2,2'-stilbenedisulfonate.

Alkoxylated Nonionic Surfactant

The fluorescent brightener premix of the present invention comprises an alkoxylated nonionic surfactant as a solvent at a level of 10% to 80%, by weight of the premix. The level of the alkoxylated nonionic surfactant could be adjusted within the range of 10% to 80% by weight, depending on context. Generally, a premix containing water (an optional ingredient) comprises less amount of the alkoxylated nonionic surfactant than a premix without water. In one embodiment, the fluorescent brightener premix herein comprises water, and from 10% to 45%, alternatively from 15% to 40%, alternatively from 20% to 35%, by weight of the premix, of the alkoxylated nonionic surfactant. In an alternative embodiment, the premix is substantially free of water and comprises from 46% to 80%, alternatively from 50% to 75%, alternatively from 60% to 70%, by weight of the premix, of the alkoxylated nonionic surfactant.

In the fluorescent brightener premix, the weight ratio of the fluorescent brightener to the alkoxylated nonionic surfactant could be at any suitable level to fully dissolve the fluorescent brightener in the alkoxylated nonionic surfactant. In one embodiment, the weight ratio of the fluorescent brightener to the alkoxylated nonionic surfactant is from 1:3 to 1:30, respectively, preferably from 1:4 to 1:20, more preferably from 1:5 to 1:15.

Non-limiting examples of alkoxylated nonionic surfactants suitable for use herein include: $C_{12}$-$C_{18}$ alkyl ethoxylates, such as Neodol® nonionic surfactants available from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as Pluronic® available from BASF; $C_{14}$-$C_{22}$ mid-chain branched alkyl alkoxylates, BAEx, wherein x is from 1-30, as discussed in U.S. Pat. No. 6,153,577, U.S. Pat. No. 6,020,303 and U.S. Pat. No. 6,093,856; alkylpolysaccharides as discussed in U.S. Pat. No. 4,565,647 Llenado; specifically alkylpolyglycosides as discussed in U.S. Pat. No. 4,483,780 and U.S. Pat. No. 4,483,779; polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408. Also useful herein as nonionic surfactants are alkoxylated ester surfactants such as those having the formula $R^1C(O)O(R_2O)nR^3$ wherein $R^1$ is selected from linear and branched $C_6$-$C_{22}$ alkyl or alkylene moieties; $R^2$ is selected from $C_2H_4$ and $C_3H_6$ moieties and $R^3$ is selected from H, $CH_3$, $C_2H_5$ and $C_3H_7$ moieties; and n has a value between 1 and 20. Such alkoxylated ester surfactants include the fatty methyl ester ethoxylates (MEE) and are well-known in the art; see for example U.S. Pat. No. 6,071,873; U.S. Pat. No. 6,319,887; U.S. Pat. No. 6,384,009; U.S. Pat. No. 5,753,606; WO 01/10391, WO 96/23049.

In one embodiment, the alkoxylated nonionic surfactant herein is $C_6$-$C_{22}$ alkoxylated alcohol, preferably $C_8$-$C_{18}$ alkoxylated alcohol, more preferably $C_{12}$-$C_{16}$ alkoxylated alcohol. The $C_6$-$C_{22}$ alkoxylated alcohol is preferably an alkyl alkoxylated alcohol with an average degree of alkoxylation of from 1 to 50, preferably 3 to 30, more preferably from 5 to 20, even more preferably from 5 to 9. The alkoxylation herein may be ethoxylation, propoxylation, or a mixture thereof, but preferably is ethoxylation. In one embodiment, the alkoxylated nonionic surfactant is $C_6$-$C_{22}$ ethoxylated alcohol, preferably $C_8$-$C_{18}$ alcohol ethoxylated with 5 to 20 moles of ethylene oxides, more preferably $C_{12}$-$C_{16}$ alcohol ethoxylated with 5 to 9 moles of ethylene oxides. The most preferred alkoxylated nonionic surfactant is $C_{12}$-$C_{15}$ alcohol ethoxylated with 7 moles of ethylene oxide, e.g., Neodol®25-7 commercially available from Shell.

Adjunct Ingredients

Preferably, the fluorescent brightener premix further comprises one or more adjunct ingredients. The adjunct ingredient is preferably selected from the group consisting of organic solvent, water, and a combination thereof. In addition to these preferred adjunct ingredients, the premix may also comprise impurities, e.g., salt residues resulting from the fluorescent brightener manufacturing process. In the present invention, it has been surprisingly found that the premix herein does not require high purity of the fluorescent brightener raw material, i.e., the solvent used by the present invention is relatively compatible with the impurities from the raw material.

In one embodiment, the premix further comprises an organic solvent at a level of from 1% to 30%, by weight of the premix. Preferably the organic solvent is present from 5% to 30%, alternatively from 10% to 25%, alternatively from 15% to 25%, by weight of the premix.

The organic solvent herein is preferably an alcohol. The alcohol is preferably selected from the group consisting of ethanol, ethylene glycol, diethylene glycol, propylene glycol, glycerol, sodium cumene sulfonate (SCS), sodium toluene sulfonate (NaTS), sodium xylene sulfonate (SXS), and a combination thereof. More preferably, the organic solvent herein is a $C_1$-$C_4$ alcohol. The $C_1$-$C_4$ alcohol is preferably selected from the group consisting of ethanol, ethylene glycol, diethylene glycol, propylene glycol, glycerol, and a combination thereof. Most preferably, the $C_1$-$C_4$ alcohol is propylene glycol.

In one embodiment, the premix further comprises water. Water can be present in the premix at any suitable level, preferably from 5% to 80%, more preferably from 30% to 75%, even more preferably from 50% to 70%, by weight of the premix. Alternatively, the premix is substantially free of water. In this no-water execution, the premix preferably comprises from 50% to 75% of the alkoxylated nonionic surfactant and from 10% to 25% of the organic solvent, by weight of the premix.

In a highly preferred embodiment, the fluorescent brightener premix herein comprises:

a) from 5% to 10%, preferably from 6% to 9%, by weight of the premix, of disodium 4,4'-bis {[4-anilino-6-morpholino-s-triazin-2-yl]-amino}-2,2'-stilbenedisulfonate;

b) from 50% to 75%, preferably from 60% to 70%, by weight of the premix, of $C_{12}$-$C_{16}$ alcohol ethoxylated with 5 to 9 moles of ethylene oxides; and c) from 10% to 25%, preferably from 15% to 25%, by weight of the premix, of propylene glycol, wherein the premix has a pH value of about 6.5 to about 8 when diluted in water at a concentration of 1% and is preferably substantially free of monoethanolamine. More preferably, the premix is substantially free of water.

Premix Preparation

The fluorescent brightener premix of the present invention is generally prepared by combining the fluorescent brightener with the alkoxylated nonionic surfactant by conventional methods such as those known in the art of making liquid premixes. Such methods typically involve mixing the essential and optional ingredients in any desired order to a relatively uniform state, with or without heating, cooling, application of vacuum, and the like, thereby providing premixes containing ingredients in the requisite concentrations.

In one embodiment, the fluorescent brightener premix of the present invention is prepared by first adding the alkoxylated nonionic surfactant into a suitable mixing vessel, e.g., a vessel with a Z/T of about 1.0 containing agitators with a D/T of about 0.3, and then adding the fluorescent brightener to the vessel. In the execution of organic solvent-containing premix, the premix is prepared by adding the organic solvent and alkoxylated nonionic surfactant, preferably in a sequential order, to the mixing vessel. After these two ingredients have mixed well (e.g., agitating for about 10 minutes), the fluorescent brightener is added to the mixture of the organic solvent and alkoxylated nonionic surfactant. Agitation preferably starts from the addition of the first ingredient and continues until achieving a clear, isotropic solution of the final fluorescent brightener premix that has a commercially acceptable viscosity and that is substantially free of any floating particles. The agitation typically lasts for several hours, alternatively at least 0.1 hour, alternatively less than 5 hours, alternatively from 0.5 to 4 hours, alternatively from 1 to 3 hours. Once all the ingredients have been delivered to the mixing vessel, the entire mixture is preferably agitated for an additional certain amount of time, alternatively at least 0.1 hour, alternatively less than 4 hours, alternatively from 0.5 to 3 hours, alternatively from 1 to 2.5 hours, to allow for complete dissolution or dispersion of the fluorescent brightener.

During each of the mixing steps, adequate energy of agitation is applied, for example, enough agitation energy to create a slight vortex in the sample and ensure that the fluorescent brightener is dispersed across the surface of the fluid and pulled down into the fluid. Typically, if the energy of agitation is not sufficient to create a vortex, then the energy of agitation is not sufficient to disperse or dissolve the fluorescent brightener at a desired rate. In one embodiment, the agitation speed is from 50 to 500 rpm, alternatively from 60 to 400 rpm, depending on factors such as the size of the mixing vessel, volume of the premix contained in the mixing vessel, and concentration of the premix. There is also an optimal delivery rate for delivering the fluorescent brightener. If the delivery rate is too high, the fluorescent brightener tends to clump and excess powder collects on the fluid surface, leading to otherwise longer dissolution time. If the delivery rate is too low, good dispersion and dissolution may still be achieved, but the batch preparation time is not efficient.

In one embodiment, the mixing steps are conducted under a temperature of from 10° C. to 60° C., preferably from 20° C. to 50° C., more preferably from 30° C. to 40° C. It is worth noting that the fluorescent brightener premix of the present invention does not require a relatively high preparation temperature and therefore there is typically no need for an additional heating system in the process. Also, the premix herein typically does not require a high storage temperature. The typical storage temperature for the premix is from 10° C. to 50° C., preferably from 15° C. to 40° C., more preferably from 20° C. to 35° C. By contrast, the premixes in the art typically require a relatively high preparation temperature and/or storage temperature, e.g., above 40° C.

The fluorescent brightener premix may be either added directly to a liquid cleaning composition upon being made, or stored for a certain period of time and then added to a liquid cleaning composition. During storage, agitation may or may not be applied to the premix. In one preferred embodiment, the premix is stored without agitation for about 1 to 5 weeks, alternatively 2 to 4 weeks, whilst maintaining physical stability. By contrast, those premixes in the art typically require a continuous agitation during storage; otherwise they cannot maintain physical stability for several weeks.

Liquid Cleaning Composition

A further aspect of the present invention is directed to a liquid cleaning composition comprising the fluorescent brightener premix as described above. It is worth noting that in certain embodiment, the liquid cleaning composition may comprise two or more fluorescent brightener premixes that contain different fluorescent brighteners. These two or more fluorescent brightener premixes are preferably added separately to the liquid cleaning composition. The liquid cleaning composition preferably comprises from 0.1% to 5%, preferably from 0.5% to 3%, more preferably from 0.8% to 1.5%, by weight of the composition, of the fluorescent brightener premix. In one embodiment, the liquid cleaning composition comprises from 0.001% to 1%, preferably from 0.01% to 0.5%, more preferably from 0.05% to 0.1%, by weight of the composition, of the fluorescent brightener.

The liquid cleaning composition may be packaged in a container (preferably containing multiple doses) or encapsulated within a water-soluble film (e.g., a polyvinyl alcohol film) as a unit dose. The unit dose may contain one or more compartments. In the multi-compartment execution, the liquid cleaning composition of the present invention may be contained in one or more compartments of the multiple compartments or contained in each compartment of the multiple compartments.

The liquid cleaning composition herein may be acidic or alkali or pH neutral, depending on the ingredients incorporated in the composition. The pH range of the liquid cleaning composition is preferably from about 5 to 11, alternatively from about 7 to 9. It is worth noting that the fluorescent brightener premix of the present invention has a relatively neutral pH, as well as a pH value close to the pH of the liquid cleaning composition, thus not causing significant impact on the pH of the liquid cleaning composition.

The liquid detergent composition herein may comprise one or more additional ingredients. Suitable additional materials include but are not limited to: anionic surfactants, cationic surfactants, nonionic surfactants, fatty acids, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, structure elasticizing agents, fabric softeners, carriers, hydrotropes, processing aids, solvents, hueing agents, anti-microbial agents, perfume oils, perfume microcapsules, structurants and/or pigments.

In addition to the disclosure below, suitable examples of such other adjuncts and levels of use are found in U.S. Pat. Nos. 5,576,282, 6,306,812, and 6,326,348. The precise nature of these additional ingredients and the levels thereof in the liquid detergent composition will depend on factors like the specific type of the composition and the nature of the cleaning operation for which it is to be used.

In one embodiment, the composition comprises an anionic surfactant. Non-limiting examples of anionic surfactants include: linear alkylbenzene sulfonate (LAS), preferably $C_{10}$-$C_{16}$ LAS; $C_{10}$-$C_{20}$ primary, branched-chain and random alkyl sulfates (AS); $C_{10}$-$C_{18}$ secondary (2,3) alkyl sulfates; sulphated fatty alcohol ethoxylate (AES), preferably $C_{10}$-$C_{18}$ alkyl alkoxy sulfates ($AE_xS$) wherein preferably x is from 1-30, more preferably x is 1-3; $C_{10}$-$C_{18}$ alkyl alkoxy carboxylates preferably comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242, and WO 99/05244; methyl ester sulfonate (MES); and alpha-olefin sulfonate (AOS). Preferably, the composition comprises an anionic surfactant selected from the group consisting of LAS, AES, AS, and a combination thereof, more preferably selected from the group consisting of LAS, AES, and a combination thereof. The total level of the anionic surfactant(s) may be from 5% to 95%, alternatively from 8% to 70%, alternatively from 10% to 50%, alternatively from 12% to 40%, alternatively from 15% to 30%, by weight of the liquid detergent composition.

In one embodiment, the liquid cleaning composition comprises an alkanolamine (e.g., MEA) as a neutralizer. As discussed early, the fluorescent brightener is preferably substantially free of MEA, which does not necessarily mean that the final liquid cleaning composition cannot comprise MEA.

Composition Preparation

The liquid cleaning composition of the present invention is generally prepared by conventional methods such as those known in the art of making liquid cleaning compositions. Such methods typically involve mixing the essential and optional ingredients in any desired order to a relatively uniform state, with or without heating, cooling, application of vacuum, and the like, thereby providing liquid cleaning compositions containing ingredients in the requisite concentrations.

In one embodiment, the process of making the liquid cleaning composition herein comprises the step of combining the fluorescent brightener premix with an anionic surfactant to form the liquid cleaning composition. The fluorescent brightener premix may be combined with the anionic surfactant at any point in the manufacture process of the liquid cleaning composition. In one embodiment, the combining step is a batch process or an in-line process, but preferably is an in-line process. A liquid cleaning composition precursor that constitutes the main portion of a final composition flows through a line, and other finishing ingredients or minors are added into the flow, to form the final liquid cleaning composition. The precursor is hereinafter referred to as a "white base", which comprises the main portion of a liquid cleaning composition, e.g., anionic surfactants, cationic surfactants, nonionic surfactants, and fatty acids. The finishing ingredients or minors may vary from product to product, and non-limiting examples of these ingredients include fluorescent brightener, dye, perfume oil, perfume microcapsule, structurant. In the in-line process, the fluorescent brightener premix is added into the flow of white base. Such an in-line process is described in the following references: US Patent Publication No. 2008/0031084 and No. 2008/0031085. In one preferred embodiment, the white base is made by a batch process or a recirculatory batch process. Such a recirculatory batch process comprises a batch container and a recirculatory loop in fluid communication with the batch container, wherein the ingredients to form the white base are added to the batch container or to the recirculatory loop via one or more dispensers. One example of the recirculatory batch process is described in PCT application No. PCT/CN2013/083117 (including its subsequent national phase patent application publications in U.S., Japan, China, and Europe).

EXAMPLES

The Examples herein are meant to exemplify the present invention but are not used to limit or otherwise define the scope of the present invention. Examples 1A-1D and 3A-3C are illustrative of the present invention, while Examples 2A-2B are comparative examples.

Examples 1-2: Formulations of Fluorescent Brightener Premixes

The following fluorescent brightener premixes shown in Table 1 are made comprising the listed ingredients in the listed proportions (weight %).

TABLE 1

| | 1A | 1B | 1C | 1D | Comparative 2A | Comparative 2B |
|---|---|---|---|---|---|---|
| Brightener 15 a | 6.2 | 3.1 | 3.1 | 5 | 6.2 | 7.7 |
| Neodol ®25-7 b | 69.5 | 15.8 | 31.6 | 20.2 | 24.7 | 0 |
| Propylene glycol | 24.3 | 0 | 0 | 0 | 0 | 30 |
| Glycerol | 0 | 4.2 | 8.4 | 0 | 0 | 0 |
| Monoethanolamine | 0 | 0 | 0 | 0 | 19.8 | 62.3 |
| Water | 0 | 76.9 | 56.9 | 74.8 | 49.4 | 0 |

a disodium 4,4'-bis{[4-anilino-6-morpholino-s-triazin-2-yl]-amino}-2,2'-stilbenedisulfonate as a fluorescent brightener, available under the tradename Tinopal AMS-GX by Ciba Geigy Corporation b Neodol ®25-7 is $C_{12}$-$C_{15}$ alcohol ethoxylated with 7 moles of ethylene oxide as a nonionic surfactant, available from Shell

Preparation of the Fluorescent Brightener Premixes of Examples 1A-1C

The premixes of Examples 1A-1C are prepared by the following steps:

a) adding propylene glycol (if any), glycerol (if any), and water (if any) into a mixing vessel with a Z/T of about 1.0 containing agitators with a D/T of about 0.3, and starting agitation at an agitation speed of 100 rpm;

b) adding Neodol®25-7 into the vessel, and agitating for about 10 minutes; and c) adding brightener 15 into the vessel, and agitating for about 70 minutes, wherein each ingredient in the composition is present in the amount as specified for Examples 1A-1C in Table 1, and wherein the process is operated at 25° C.

Preparation of the Fluorescent Brightener Premix of Examples 1D

The premix of Example 1D is prepared by the following steps:

a) adding Neodol®25-7 into a mixing vessel with a Z/T of about 1.0 containing agitators with a D/T of about 0.3, and starting agitation at an agitation speed of 100 rpm;

b) adding water into the vessel, and agitating for about 10 minutes; and c) adding brightener 15 into the vessel, and agitating for about 70 minutes, wherein each ingredient in the composition is present in the amount as specified for Example 1D in Table 1, and wherein the process is operated at 25° C.

Preparation of the Fluorescent Brightener Premix of Comparative Example 2a

The premix of Comparative Example 2A is prepared by the following steps:

a) adding water into a mixing vessel with a Z/T of about 1.0 containing agitators with a D/T of about 0.3, and starting agitation at an agitation speed of 100 rpm;

b) adding monoethanolamine (MEA) into the vessel, and agitating for about 10 minutes;

c) adding brightener 15 into the vessel, and agitating for about 10 minutes; and d) adding Neodol®25-7 into the vessel, and agitating for about 70 minutes, wherein each ingredient in the composition is present in the amount as specified for Comparative Example 2A in Table 1, and wherein the process is operated at around 48° C.

Preparation of the Fluorescent Brightener Premix of Comparative Example 2B

The premix of Comparative Example 2B is prepared by the following steps:

a) adding propylene glycol into a mixing vessel with a Z/T of about 1.0 containing agitators with a D/T of about 0.3, and starting agitation at an agitation speed of 100 rpm;

b) adding MEA into the vessel, and agitating for about 10 minutes; and c) adding brightener 15 into the vessel, and agitating for about 10 minutes, wherein each ingredient in the composition is present in the amount as specified for Comparative Example 2B in Table 1, and wherein the process is operated at around 25° C.

Comparative Data of Examples 1-2 pH Value

Comparative experiments of assessing the pH values of the fluorescent brightener premixes of Examples 1A and Comparative Examples 2A and 2B, are conducted. Specifically, the pH of a premix is measured at two time points: 1) right after the premix is made ("initial pH") and 2) when the premix is diluted in deionized water at a concentration of 1% ("diluted pH"). The pH is measured by a METTLER TOLEDO Seven Compact 5220 pH meter at 25° C. The pH values of the premixes are shown in Table 2.

TABLE 2

| | 1A | 2A | 2B |
|---|---|---|---|
| Initial pH | 9.6 | 11.8 | 12.9 |
| Diluted pH | 6.7 | 10.7 | 11 |

As shown in Table 2, the fluorescent brightener premix according to the present invention (Example 1A) demonstrates a much lower pH value when diluted in water at a concentration of 1%, than the comparative premixes (Comparative Examples 2A and 2B), albeit the three premixes do not have a significant difference in their initial pH values. Such a lower diluted pH value minimizes the impact of the premix on the pH of liquid composition to which it is added.

Stability Assessment

Comparative experiments of assessing the physical stability of the fluorescent brightener premixes of Examples 1A-1D and Comparative Examples 2A-2B, are conducted. Specifically, the stability is assessed 1) when the premixes are freshly made at 25° C. and 2) when the premixes are stored for 4 weeks under different temperature conditions using visual assessment of any changes. The physical stabilities of the premixes are shown in Table 3.

TABLE 3

| Stability | 1A | | | 1B | | | 1C | | | 1D | | |
|---|---|---|---|---|---|---|---|---|---|---|---|---|
| Fresh | | Stable | | | Stable | | | Stable | | | Stable | |
| Stored for 4 weeks at | 15 | 35 | 40 | 15 | 35 | 40 | 15 | 35 | 40 | 15 | 35 | 40 |
| Temperature/° C. | Stable | Stable | Stable | Stable | Stable | Stable | Stable | Stable | Stable | Stable | Stable | Stable |

| | 2A | | 2B | |
|---|---|---|---|---|
| Fresh | Unstable | | Stable | |
| Stored for 4 weeks at | * | 15 | 35 | 40 |
| Temperature/° C. | | Stable | Stable | Stable |

1. "Stable" indicates that there was no phase splitting in the premix and the premix was consistent with a clear to slightly yellow isotropic solution that is substantially free of any visible floating materials.

2. "Unstable" indicates that the premix composition sample exhibited a thick, gel-like consistency.

3. * The stability of the premix of Comparative Example 2A when stored for 4 weeks under different temperature conditions is not assessable because this premix is not stable since it's freshly made.

As shown in Table 3, all of the fluorescent brightener premixes according to the present invention (Examples 1A-1D) demonstrate improved physical stability while being tested at different temperature conditions. By contrast, the premix of Comparative Example 2A is unstable at 25° C. when freshly made, and therefore the stability of this premix under different storage temperature conditions is not assessable. Indeed, the premix of Comparative Example 2A requires a storage temperature to be at least above 40° C. to maintain stable, as well as a continuous agitation during storage. Moreover, although the premix of Comparative Example 2B is stable at these conditions, this premix has the highest pH value when diluted, as shown in Table 2.

Example 3: Formulations of Liquid Laundry Detergent Compositions

The following liquid laundry detergent compositions shown in Table 4 are made comprising the listed ingredients in the listed proportions (weight %).

TABLE 4

| | 3A | 3B | 3C |
|---|---|---|---|
| $C_{12-14}AE_{1-3}S$ | 17.7 | 7 | 18 |
| $C_{11-13}LAS$ | 3.2 | 3 | 15 |
| Surfonic ®L24-9 a | 0 | 4 | 21 |
| Citric acid | 4.2 | 3 | 4 |
| Boric acid | 3 | 0 | 0 |
| $C_{12}$-$C_{18}$ fatty acid | 0 | 4 | 8 |
| Na-DTPA b | 0.6 | 0.2 | 0.2 |
| Propylene glycol | 0 | 5 | 14 |
| Monoethanolamine | 0 | 1 | 8 |
| Glycerol | 4.5 | 0 | 0 |
| Ethanol | 0 | 1 | 0 |
| Potassium sulfite | 0 | 0.2 | 0 |
| NaOH | Up to pH 8 | Up to pH 8 | Up to pH 8 |
| Fluorescent brightener premix of Example 1A | 0.9 | 0.9 | 0.9 |
| Protease | 0 | 0.5 | 0.5 |
| Amylase | 0 | 0.1 | 0.1 |
| Dye | 0 | 0.002 | 0.002 |
| Perfume microcapsule | 0 | 0 | 0.5 |
| Perfume oil | 0 | 0.3 | 0.5 |
| Water | Add to 100 | Add to 100 | Add to 100 |

a Surfonic ®L24-9 is $C_{12-14}$ alcohol ethoxylated with 9 moles of ethylene oxide as a nonionic surfactant, available from Huntsman
b penta sodium salt diethylene triamine penta acetic acid as a chelant Preparation of the Liquid Laundry Detergent Compositions of Examples 3A-3C The liquid detergent compositions of Examples 3A-3C are prepared by the following steps:

a) mixing a combination of NaOH and water in a batch container by applying a shear of 200 rpm;

b) adding citric acid, boric acid (if any), $C_{11}$-$C_{13}$ LAS, and NaOH into the batch container, keeping on mixing by applying a shear of 200 rpm;

c) cooling down the temperature of the combination obtained in step b) to 25° C.;

d) adding glycerol (if any) into the batch container;

e) adding $C_{12-14}AE_{1-3}S$, Na-DTPA, Surfonic® L24-9 (if any), $C_{12}$-$C_{18}$ fatty acid (if any), propylene glycol (if any), monoethanolamine (if any), ethanol (if any), and potassium sulfite (if any) into the batch container, mixing by applying a shear of 250 rpm until the combination is homogeneously mixed, and adjusting pH to 8, thereby forming a white base; and f) the white base obtained in step e) flowing out of the batch container and flowing through a separate in-line process, wherein protease (if any), amylase (if any), dye (if any), fluorescent brightener premix, perfume oil (if any), and perfume microcapsule (if any) are added separately into the white base during the in-line process, thus forming a liquid laundry detergent composition, wherein each ingredient in the composition is present in the level as specified for Examples 3A-3C in Table 4.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluorescent brightener premix consisting of:

a) from about 3% to about 6%, by weight of the premix, of disodium 4,4'-bis{[4-anilino-6-morpholino-s-triazin-2-yl]-amino}-2,2'-stilbenedisulfonate having a weight average primary particle size of from about 30 to 400 micrometers, b) from about 15% 60% to about 75% 70%, by weight of the premix, of $C_{12}$-$C_{16}$ alcohol ethoxylated with 7 moles of ethylene oxide, and c) from about 15% to about 25%, by weight of the premix, of propylene glycol;

wherein the premix has a pH value of about 6.5 to about 7.0 when diluted in water at a concentration of 1%.

2. The premix according to claim 1, wherein the weight ratio of said disodium 4,4'-bis{[4-anilino-6-morpholino-s-triazin-2-yl]-amino}-2,2'-stilbenedisulfonate to said $C_{12}$-$C_{16}$ alcohol ethoxylated with 7 moles of ethylene oxide is from about 1:3 to about 1:30, respectively.

3. A process of making the fluorescent brightener mix according to claim 1, comprising the step of: combining said disodium 4,4'-bis{[4-anilino-6-morpholino-s-triazin-2-yl]-amino}-2,2'-stilbenedisulfonate said $C_{12}$-$C_{16}$ alcohol ethoxylated with 7 moles of ethylene oxide, and said propylene glycol.

4. The process according to claim 3, wherein the step of combining is conducted under a temperature of from about 20° C. to 50° C.

5. A process of making a liquid cleaning composition comprising the fluorescent brightener mix according to claim 1, comprising the step of: combining the fluorescent brightener premix with an anionic surfactant to form the liquid cleaning composition, wherein said anionic surfactant is selected from the group consisting of alkyl ethoxy sulfate (AES), alkyl sulfate (AS), linear alkylbenzene sulfonate (LAS), and a combination thereof, wherein the fluorescent brightener premix is present in the liquid cleaning composition from about 0.1% to about 5% by weight of the liquid cleaning composition.

6. The process according to claim 5, wherein said combining step is in-line.

* * * * *